US008926202B2

(12) United States Patent
Nakada

(10) Patent No.: US 8,926,202 B2
(45) Date of Patent: Jan. 6, 2015

(54) IMAGE FORMING APPARATUS

(71) Applicant: Kikuya Nakada, Kanagawa (JP)

(72) Inventor: Kikuya Nakada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/055,025

(22) Filed: Oct. 16, 2013

(65) Prior Publication Data

US 2014/0146105 A1 May 29, 2014

(30) Foreign Application Priority Data

Nov. 26, 2012 (JP) ..... 2012-257984

(51) Int. Cl.
*B41J 15/00* (2006.01)

(52) U.S. Cl.
USPC ..... 400/618; 400/613; 347/16

(58) Field of Classification Search
USPC ..... 347/5, 9, 16; 700/130, 139; 242/421, 242/422; 400/613, 618
See application file for complete search history.

(56) References Cited

U.S. PATENT DOCUMENTS

| | | | | |
|---|---|---|---|---|
| 6,405,098 | B1 * | 6/2002 | Mehlis et al. | 700/139 |
| 8,011,611 | B2 * | 9/2011 | Yoshimaru et al. | 242/421 |
| 8,322,644 | B2 | 12/2012 | Nakada et al. | |
| 2009/0016797 | A1 | 1/2009 | Brugue et al. | |
| 2009/0269119 | A1 | 10/2009 | Hatada et al. | |
| 2011/0211031 | A1 | 9/2011 | Satoh et al. | |
| 2012/0032021 | A1 | 2/2012 | Morinaga et al. | |
| 2013/0126659 | A1 | 5/2013 | Nakada | |
| 2013/0222457 | A1 | 8/2013 | Nakada et al. | |

FOREIGN PATENT DOCUMENTS

| | | |
|---|---|---|
| JP | 09-164737 | 6/1997 |
| JP | 2003-276264 | 9/2003 |
| JP | 2009-256061 | 11/2009 |

OTHER PUBLICATIONS

European Search Report dated Mar. 7, 2014 in corresponding European patent application No. 13 18 8362.1.

* cited by examiner

*Primary Examiner* — Lam S Nguyen
(74) *Attorney, Agent, or Firm* — Cooper & Dunham LLP

(57) ABSTRACT

A load applying unit includes a motor and a rotation transmission mechanism.

A unit for causing the motor to be in a state where the motor creates a counter-electromotive force when rotational force from the roll body is received by applying a voltage less than a minimum driving voltage to the motor and a unit for changing a conveyance speed with which the conveyance unit conveys the print medium are included. While the print medium is pulled out from the roll body and the print medium is set in a state where image forming can be started, the motor is caused to be in the state where the motor can create the counter-electromotive force, and the conveyance unit performs a conveyance operation by changing the conveyance speed of the print medium in accordance with a detection result of the detecting unit.

5 Claims, 11 Drawing Sheets

IMAGE FORMING APPARATUS

BACKGROUND OF THE INVENTION

1. Field of the Invention

The disclosures herein generally relate to an image forming apparatus.

2. Description of the Related Art

Some image forming apparatuses, including a printer, a copy machine, a plotter or a multifunction machine, may use a long rolled continuous print medium (hereinafter, referred to as a "roll of paper").

In this kind of image forming apparatus, a load in a direction opposite to the medium conveyance direction of the roll of paper (a back tension) is applied in order to avoid wrinkling or twisting caused by skewed conveyance in which the roll of paper is conveyed in a skewed manner.

Conventionally, for example, a sophisticated method of correcting the skewed conveyance is known in which a torque limiter is included in a spool that supports the roll of paper in a rotationally free manner so that a rotational load is applied when rolling out the roll of paper, and in which a conveyance power changeable unit made of an electromagnetic clutch, which can change the conveyance power of the roll of paper, is included so that the back tension is controlled by setting a voltage applied for the electromagnetic clutch in accordance with a detected width of the roll of paper (refer to Patent Document 1).

Also, a method of variably controlling a back tension applied to the roll of paper is known in which a powder clutch engaged with a flange of the roll of paper is included for applying the back tension and in which an amount of electric power that is applied to the powder clutch is controlled in accordance with an output from a remaining amount of roll of paper detecting unit (refer to Patent Document 2).

In a configuration using an electromagnetic clutch or a powder clutch for changing the strength of the back tension, however, there is a problem that the configuration or the control becomes complicated and the cost becomes high.

[Patent Document 1] Japanese Patent Application Publication No. 2009-256061

[Patent Document 2] Japanese Patent Application Publication No. H09-164737

SUMMARY OF THE INVENTION

It is a general object of at least one embodiment of the present invention to provide a simple configuration or a simple control mechanism for changing the back tension that substantially obviates one or more problems caused by the limitations and disadvantages of the related art.

In one embodiment of the present invention, an image forming apparatus includes a roll body in which a print medium is rolled in a roll, a conveyance unit configured to convey the print medium, and a load applying unit configured to apply a load to the roll body in a direction opposite to a medium conveyance direction. The load applying unit includes a motor and a rotation transmission mechanism placed between the motor and the roll body. The image forming apparatus further includes a unit configured to cause the motor to be in a state where the motor creates a counter-electromotive force when rotational force from the roll body is received, by causing the motor to be in an electrically shorted state or by applying a voltage less than a minimum driving voltage to the motor, a detecting unit configured to detect print medium information of the roll body, and a conveyance speed changing unit configured to change a conveyance speed with which the conveyance unit conveys the print medium. While a portion of the print medium that is pulled out from the roll body is set in a state where image forming thereon can be started, the motor is caused to be in the state where the motor creates the counter-electromotive force, and the conveyance unit conveys the print medium by controlling the conveyance speed of the print medium in accordance with the medium information detected by the detecting unit.

According to the present embodiment, the back tension can be changed with a simple configuration or a simple control mechanism.

BRIEF DESCRIPTION OF THE DRAWINGS

Other objects and further features of embodiments will become apparent from the following detailed description when read in conjunction with the accompanying drawings.

DESCRIPTION OF THE PREFERRED EMBODIMENTS

Figure 1:
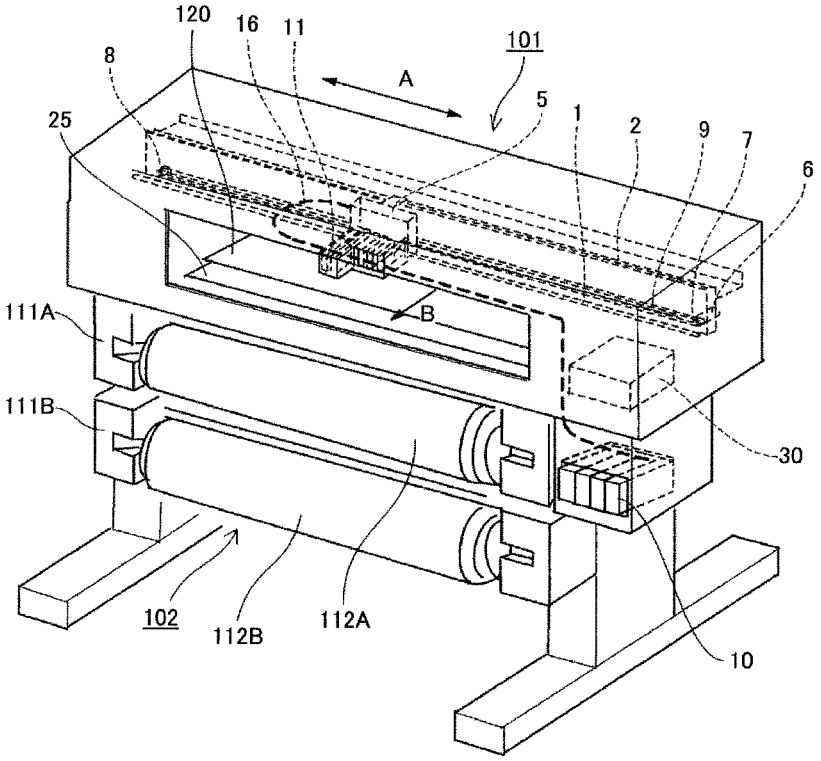
FIG. 1 is a drawing illustrating a perspective view of an embodiment of an image forming apparatus.
Figure 2:
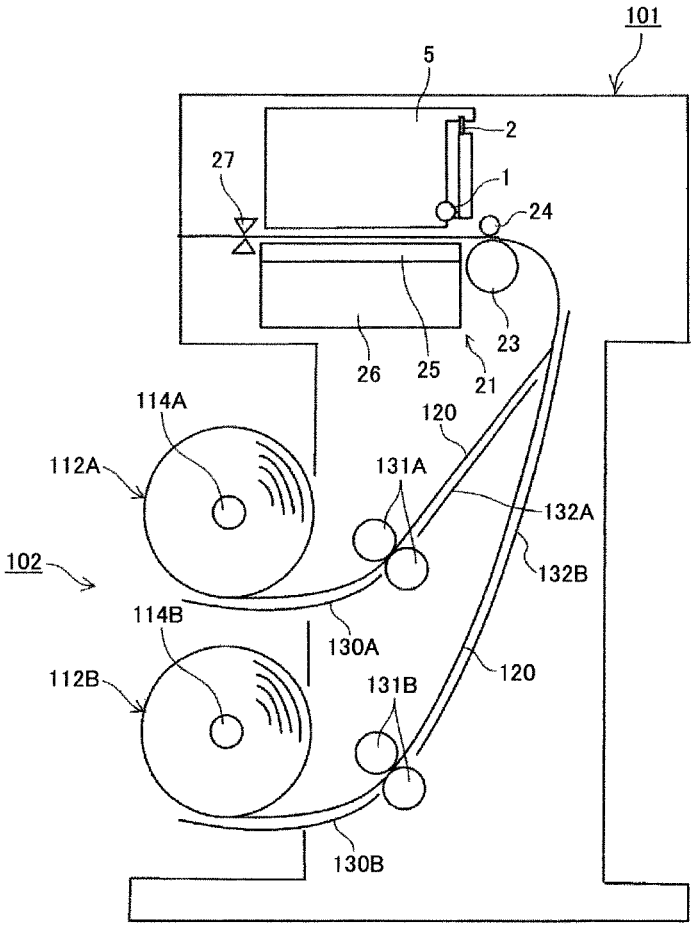
FIG. 2 is a drawing illustrating a side view of the embodiment of the image forming apparatus.
Figure 3:
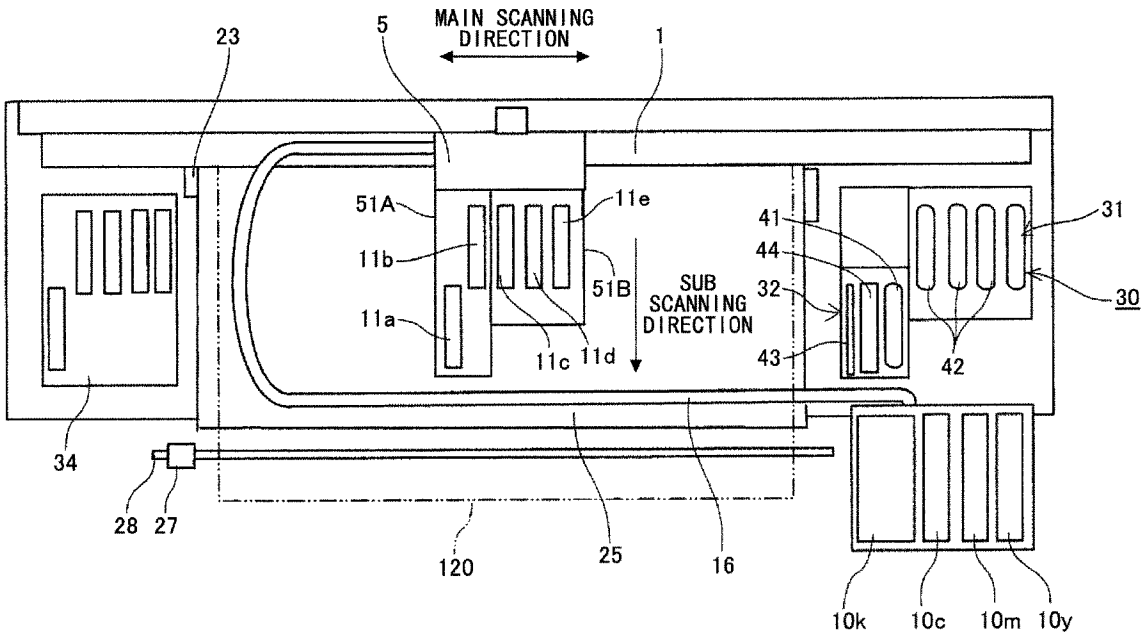
FIG. 3 is a drawing illustrating a top view of the embodiment of the image forming apparatus.

In the following, embodiments of the present invention will be described with reference to the accompanying drawings. An embodiment of an image forming apparatus according to the present invention will be described referring to FIG. 1 through FIG. 3. FIG. 1 is a drawing illustrating a perspective view of the embodiment of the image forming apparatus. FIG. 2 is a drawing illustrating a side view of the embodiment of the image forming apparatus. FIG. 3 is a drawing illustrating a top view of the embodiment of the image forming apparatus.

The image forming apparatus is a serial type image forming apparatus and includes a main body 101 and a paper feeding apparatus 102 under the main body 101. Note that the paper feeding apparatus 102 is configured as a separate apparatus from the main body 101 in this embodiment, but may be integrated with the main body 101 as shown in FIG. 2.

Inside of the main body 101 are guide members, a guide rod 1 and a guide stay 2, lying between a pair of side plates (not shown in the figures). There is a carriage 5 which is supported by the guide rod 1 and the guide stay 2 and is capable of moving in a direction indicated by an arrow "A" in FIG. 1 (main scanning directions or carriage-moving directions in FIG. 3).

A main scanning mechanism unit, which causes the carriage 5 to make a scanning movement, includes a main scanning motor 6, which is placed in one side in the main scanning directions, a driving pulley 7, which is driven to rotate by the main scanning motor 5, a slave pulley 8, which is placed in another side in the main scanning directions, and a timing belt 9, which is a pulling member looped around the driving pulley 7 and the slave pulley 8.

In the carriage 5, as shown in FIG. 3, there are multiple (here, five) recording heads 11*a* through 11*e* (collectively referred to as "recording head 11"), each of which includes a liquid-jet head that jets ink droplets of black (K), yellow (Y), magenta (M) or cyan (C) and a head tank which provides the liquid to the liquid-jet head. The multiple recording heads 11*a* through 11*e* include corresponding multiple nozzles, which are placed in an array in a sub scanning direction orthogonal to the main scanning directions, and whose direction for jetting the liquid is a downward direction.

Here, the recording head 11*e* is placed one head length (one nozzle-array length) offset from the recording heads 11*b* through 11*e* in the sub scanning direction which is orthogonal to the main scanning directions. Also, the recording heads 11*a* through 11*e* each include two arrays of nozzles. The recording heads 11*a* and 11*b* both jet the black droplets, the recording heads 11*c* through 11*e* jet droplets of magenta (M), cyan (C) or yellow (Y), respectively.

By this configuration, regarding a monochrome image, the image can be formed using the recording heads 11*e* and 11*b*, with the two-head-length width in the sub scanning direction of the image being formed in one scan (main scanning); and regarding a color image, the image can be formed using the recording heads 11*b* through 11*e*. Note that the configuration of the recording heads is not limited to this, and multiple recording heads may be placed in a matrix in both the main scanning directions and the sub scanning direction.

All colors of ink are supplied to the head tank of the recording head 11 by a flexible supplying tube 16 from ink cartridges 10*k*, 10*c*, 10*m* and 10*y* which are collectively referred to as a main tank that is exchangeably installed in the main body 101. Here, for the two recording heads 11*a* and 11*b*, which jet the droplets of the same color, the ink is supplied by the same ink cartridge 10*k*.

On the other hand, in a recording area to be scanned by the carriage 5, a roll of paper 120 is fed from a paper feeding apparatus 102 which will be described later, and is intermittently conveyed by a conveyance unit 21 in a direction which is orthogonal to the main scanning directions of the carriage 5 (the sub scanning direction or paper conveyance direction: direction indicated by an arrow "B").

The conveyance unit 21 includes a conveyance roller 23 for conveying the roll of paper 120 that is a rolled medium supplied from the paper supply apparatus 102, a pressurized roller 24, which is placed facing the conveyance roller 23, a conveyance guide member 25, on which multiple suction holes are formed, and a suction fan 26 as a suction unit for suctioning air through the suction holes of the conveyance guide member 25.

In the downstream side of this conveyance unit 21, as shown in FIG. 2, a cutter 27 is placed as a cutting unit for cutting into a predefined length a part of the roll of paper 120 on which an image is formed by the recording head 11.

The cutter 27 is attached to, for example, a wire or a timing belt 28. The timing belt 28 is looped around a driving pulley and a slave pulley which are driven by a driving motor (not shown). The cutter 27 cuts the part of the paper into the predefined length by causing the timing belt 28 to be moved by the driving motor via the driving pulley in the main scanning directions "A".

Furthermore, in one side of the main scanning directions of the carriage 5, a maintenance-and-recovery mechanism 30, which performs maintenance and recovery of the recording head 11, is placed in a side of the conveyance guide member 25. In another side of the main scanning directions of the carriage 5, a dummy jet receptacle 34 is placed to store droplets jetted in a dummy jet in which droplets not contributing to image forming are jetted from the recording head 11.

The maintenance-and-recovery mechanism 30 includes a first maintenance-and-recovery unit 31, which is supported by a frame member of the main body 101, and a second maintenance-and-recovery unit 32, which is supported by a frame member of the maintenance-and-recovery mechanism 30 and is capable of moving back and forth in the sub scanning direction. The second maintenance-and-recovery unit 32 is positioned as shown in FIG. 3 when it performs the maintenance and recovery of the recording head 11*a*, and it moves to the same position in terms of the sub scanning direction as the first maintenance-and-recovery unit 31 when it performs the maintenance and recovery of the recording heads 11*b* through 11*e*.

The maintenance-and-recovery mechanism 30 includes, for example, a suctioning cap 41, which also serves as a moisturizing cap for capping a nozzle face (a face in which nozzles are formed) of the recording head 11, moisturizing caps 42, a wiper member 43 for wiping the nozzle face, a dummy jet receptacle 44 for receiving droplets that do not contribute to the image forming (dummy droplets), etc.

The paper feeding apparatus 102 includes upper-level and lower-level spool-axle reception units 111A and 111B (hereinafter collectively referred to as "spool-axle reception unit 111")(Note that regarding the reference numerals for units included in the upper-level and the lower-level, "A" is added when referring to the upper-level unit and "B" is added when referring to the lower-level unit.) In the inside of the spool axle reception unit 111, there is a rolling-out mechanism by which the roll of paper 120 is rolled out and rolled back from/to a roll body 112.

The roll body 112 is a sheet of long rolled medium (hereinafter referred to as "roll of paper") 120 rolled around a tube 114 as a core member. Note that the roll body is a collective name for a member that includes the tube 114 and the roll of paper 120.

Here, as a roll body 112, both types can be installed: a fixed type, whose end of the roll of paper 120 is fixed to the tube 114 using adhesive material such as glue, and an un-fixed type, whose end of the roll of paper 120 is not fixed.

Furthermore, the main body 101 includes a curved guide member 130 for guiding the roll of paper 120 rolled out from the roll body 112 of the paper feeding apparatus 102, a conveyance roller pair 131 for conveying upward the roll of paper 120, and a curved guide member 132 for guiding the roll of paper 120 rolled out from the conveyance roller pair 131 in a direction of a nip of the conveyance roller 23 and the pressurizing roller 24 of the conveyance unit 21 located above.

By rotating the conveyance roller pair 131, the roll of paper 120 rolled out from the roll body 112 is conveyed, in a state of being pulled tensioned between the conveyance roller pair 131 and the roll body 112, to the nip of the conveyance roller 23 and the pressurizing roller 24 of the conveyance unit 21.

In the image forming apparatus configured as above, a certain image is formed on the part of the roll of paper 120 by moving the carriage 5 in the main scanning directions, and by driving the recording head 11 to jet droplets in accordance with image information (print information) while, using the conveyance unit 21, intermittently conveying the roll of paper 120 fed by the paper feeding apparatus 102. The part of the roll of paper 120, after the image is formed, is cut in a predefined length by the cutter 27 and is discharged to a receiving tray (not shown in the figures) placed in a front side of the main body 101.

Figure 4:
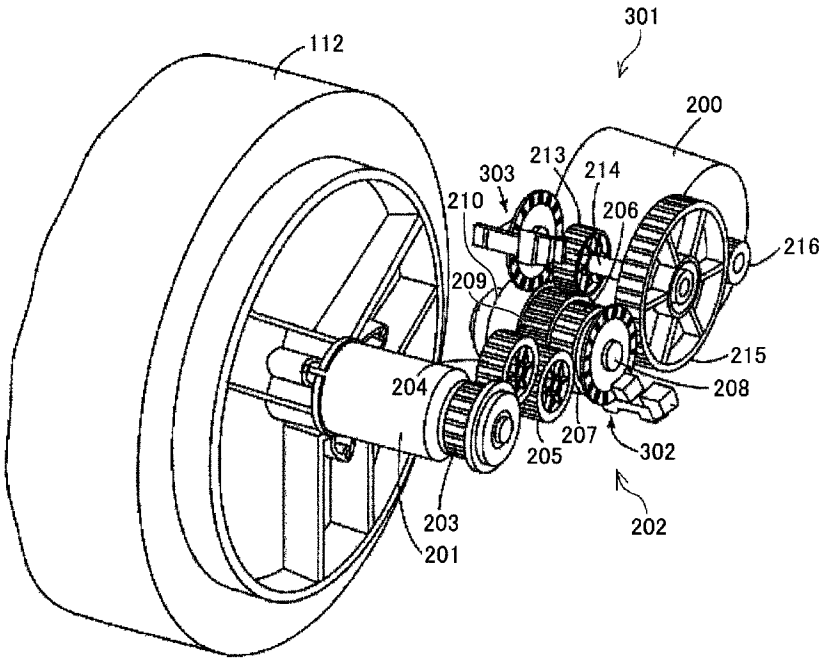
FIG. 4 is a perspective view of the back tension mechanism of the image forming apparatus.
Figure 5:
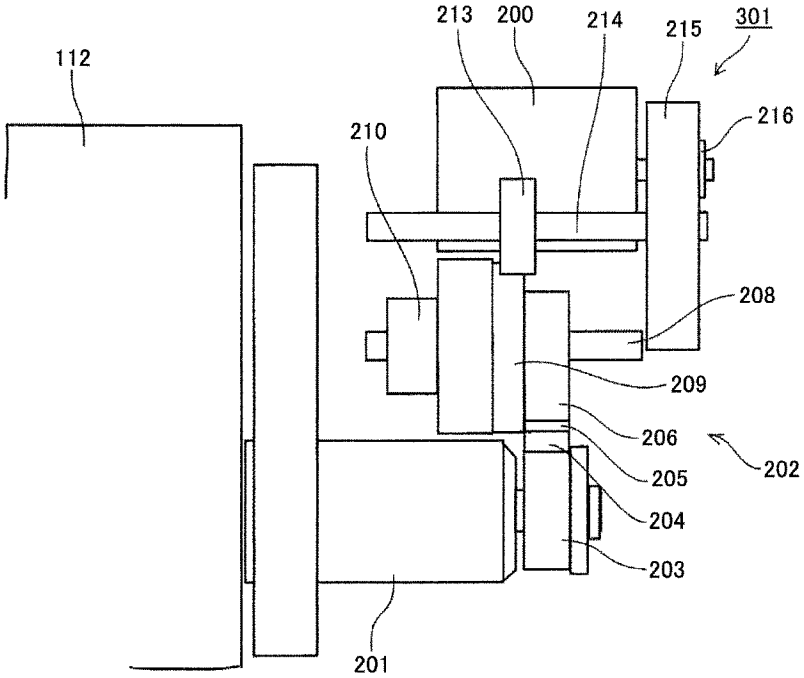
FIG. 5 is a top view of the back tension mechanism of the image forming apparatus.
Figure 6:
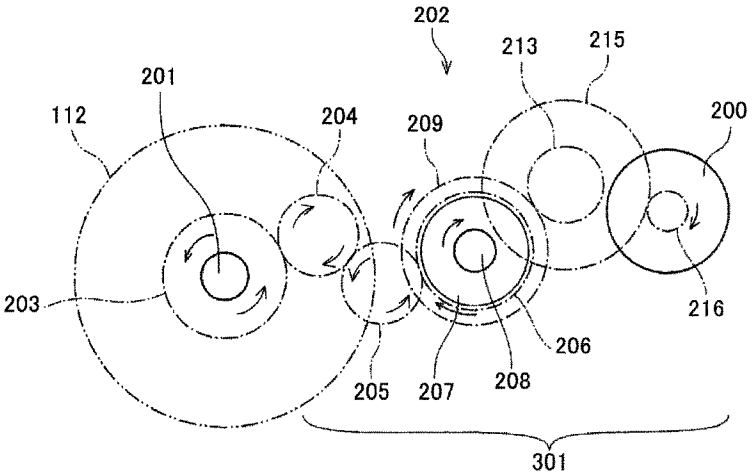
FIG. 6 is a front view of the back tension mechanism of the image forming apparatus.

Next, referring to FIG. 4 through FIG. 6, a back tension mechanism (a load applying unit 301) of the image forming apparatus will be described. FIG. 4 is a perspective view of the back tension mechanism of the image forming apparatus. FIG. 5 is a top view of the back tension mechanism of the image forming apparatus. FIG. 6 is a front view of the back tension mechanism of the image forming apparatus.

A rotation transmission mechanism 202 for connecting to a driving motor 200 is connected to a spool axle 201 of the roll body 112. By controlling rotational state of the driving motor 200, a load is applied to the spool axle 201 of the roll body 112 and a back tension is applied to the conveyed roll of paper 120. In other words, the driving motor 200 and the rotation transmission mechanism 202 constitute the load applying unit 301.

Here, the rotation transmission mechanism 202 will be described. The spool axle 201, which is attached to the tube 114 of the roll body 112, includes a slave-type gear 203 that rotates following the spool axle 201. The slave-type gear 203 is connected to meshes with a one-way clutch 207, which includes a gear 206, via idle gears 204 and 205.

A rotational axle 208, whose rotational axis is the same as the one-way clutch 207, includes a gear 209 and a torque limiter 210. Note that there is a rotary encoder 302 for detecting an amount of rotation of the rotational axle 208. A remaining amount of roll of paper 120 is detected by detecting the amount of the rotation of the rotational axle 208.

The gear 209 is connected to meshes with a transmission gear 213. The transmission gear 213 is, via an idle gear 215 included by a rotational axle 214 of the transmission gear 213, connected to meshes with a drive gear 216 of a drive motor 200, which is a driving source for rotational driving. Also, there is a rotary encoder 303 for detecting rotation of the rotational axle 214, which detects an amount of rotation of the drive motor 200.

In the load applying unit 301 configured as above, the back tension can be controlled in three levels—strong (backward-rotation), mild (no-power) and weak (forward-rotation)—by selecting a drive state of the drive motor 200 from a forward-rotation state, a backward-rotation state and a no-power state.

The back tension control will be briefly described below. In order to cause the back tension to be mild, the drive motor is caused to be in a non-magnetized state. By this, when the spool axle 201 rotates as a result of the roll body 112 being rotated in a rolling-out direction, a load is created which causes rotation of the rotation transmission mechanism 202 and the drive motor 200. This load becomes a back tension applied to the roll of paper 120.

In order to cause the back tension to be weak, the drive motor 200 is driven to rotate forward in such a speed that the gear 209 rotates faster than the gear 206 of the one-way clutch 207. By this, the gear 206 of the one-way clutch 207 is in a state of spinning around with respect to the rotational axle 208. To the spool axle 201 of the roll body 112, a load is applied which causes a rotation of the gear 206 of the one-way clutch 207 via the idle gears 204 and 205, and the back tension applied to the roll of paper 120 is weaker than the one applied when the drive motor 200 is in the non-magnetized state.

In order to cause the back tension to be strong, the drive motor 200 is driven to rotate backward. By this, because a direction of the rotational axle 208's rotation caused by the drive motor 200 becomes opposite to a direction of the gear 209's rotation caused by the rolling out of the roll body 112, a torque, which exceeds the torque limit of the torque limiter 210, is created. The transmission of the torque is blocked. In the inside of the torque limiter 210, the rotational axle 208 undergoes a spinning rotation. The spinning rotation creates a torque of resistance. The torque of resistance becomes a load for the spool axle 201's rotation and a strong back tension is applied to the roll of paper 120.

Figure 7:
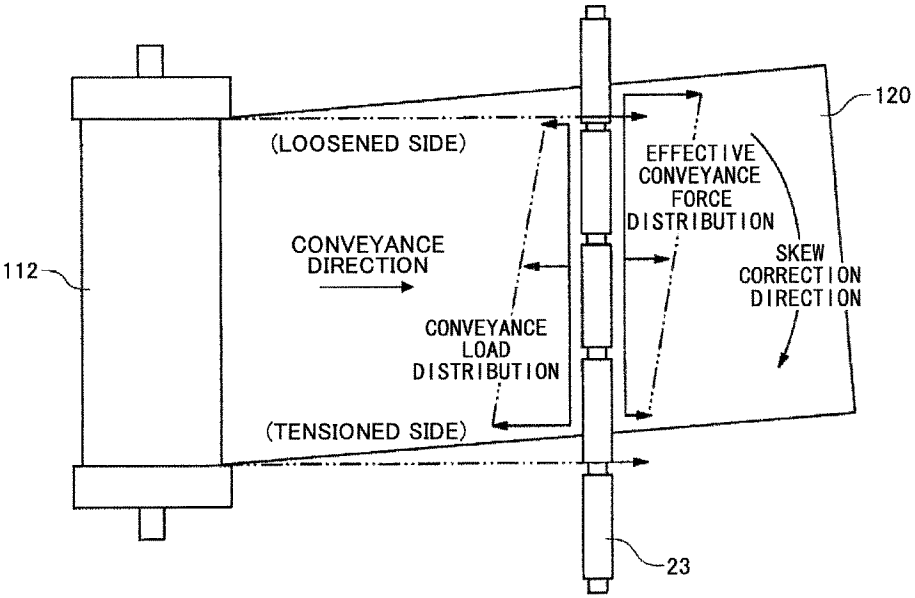
FIG. 7 is a top view illustrating a mechanism of correcting the skewed conveyance of the roll of paper by applying the back tension.

Here, a mechanism will be described referring to FIG. 7 for correcting the skewed conveyance of the roll of paper by applying the back tension. FIG. 7 is a top view illustrating a mechanism of correcting the skewed conveyance of the roll of paper by applying the back tension.

In FIG. 7, the lower side of the roll of paper 120 is tensioned among the conveyance roller 23, the pressurized roller 29 and the roll body 112, while the upper side of the roll of paper 120 is loosened. At this time, when the back tension is applied in a direction opposite to the conveyance direction of the roll of paper 120, a load, which becomes less at the loosened side and greater at the tensioned side, is applied to the roll of paper 120 as indicated by "conveyance load distribution" in FIG. 7.

At this time, the conveyance force applied to the roll of paper 120 by the conveyance roller 23 and the pressurizing roller 24 is constant in terms of the axial direction. Thus, an effective conveyance force which is actually applied to the roll of paper 120 is a difference between the conveyance force and the back tension and is indicated by "effective conveyance force" in FIG. 7.

By applying the back tension, the actual conveyance force to convey the roll of paper 120 can be greater at the loosened side and less at the tensioned side of the roll of paper 120. Thus, the skewed conveyance can be corrected.

However, as an appropriate force of the back tension is different depending on the size of the roll of paper 120, the remaining amount of the roll of paper 120, etc., the skewed conveyance may not be sufficiently corrected by applying a constant back tension to the rotational axle of the roll of paper 120.

Thus, in the above load applying unit 301, referring to FIG. 5 and FIG. 6, a case will be described in which the drive motor 200 is caused to be in an electrically shorted state or in a state where a predefined voltage, which does not drive the drive motor 200 to rotate, is applied to the drive motor 200.

Note that when a voltage necessary for driving the drive motor 200 to rotate is referred to as "minimum driving voltage", the above "predefined voltage" is a voltage less than the minimum driving voltage.

When the roll of paper 120 is conveyed in the forward direction, the spool axle 201 is rotated in the direction indicated by an arrow in FIG. 6 so that the gear 206 of the one-way clutch 207 is rotated in the direction indicated by an arrow. The one-way clutch 207 transmits its driving force to the rotational axle 208 when the one-way clutch 207 is rotated in the direction indicated by an arrow. Thus, the rotational axle 208 is rotated in the direction indicated by an arrow.

When the rotational axle 208 is rotated in the direction indicated by an arrow, the gear 209 is rotated while the torque is limited by the torque limiter 210 to rotate the drive gear 216 of the drive motor 200 via the transmission gear 213, etc.

When the drive motor 200 is controlled to be in an electrically shorted state or in a state where less than the minimum driving voltage is applied to the drive motor 200 while the roll of paper 120 is being conveyed, a load is applied to the spool axle 201 of the roll of paper 120 for causing the rotation transmission mechanism 202 and the drive motor 200 to rotate. This load becomes a back tension to the roll of paper 120.

Here, in this embodiment, in order to cause the drive gear 216 to rotate when the minimum driving voltage is applied to the drive motor 200, the drive torque of the drive motor 200 is set to be less than or equal to the limitation of the torque limiter 210.

In other words, the setting value of the torque limiter 210 is set to be greater than the drive-load torque of the drive motor 200 when a voltage less than the minimum driving voltage is applied to the drive motor 200. By setting the torque limiter 210 in this way, the drive gear 216 of the drive motor 200 is caused to rotate by the rotation of the gear 209.

By putting the drive motor 200 in an electrically shorted state or in a state where a voltage less than the minimum driving voltage is applied to the driving motor 200, the drive motor 200 is in a state where it does not rotate by itself. In this state, the drive gear 216 of the drive motor 200 is caused to rotate by the roll of paper 120 being conveyed by the conveyance roller 23 and the pressurizing roller 24 of the conveyance unit 21. Thus, a counter-electromotive force is created at the drive motor 200, and the torque from this counter-electromotive force becomes a back tension for the roll of paper 120.

Figure 8:
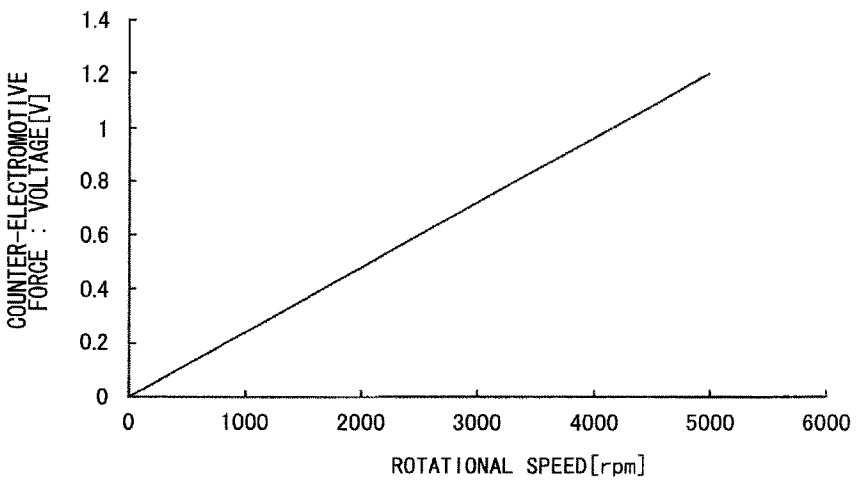
FIG. 8 is a drawing illustrating a relationship between rotational speed of the drive motor and created counter-electromotive force.

Next, relationship between the rotational speed of the drive motor 200 and the created counter-electromotive force will be described referring to FIG. 8.

Here, the rotational speed of the drive motor 200 is determined by a speed at which the roll of paper 120 is conveyed by the conveyance roller 23 and the pressurizing roller 24 of the conveyance unit 21 and an outside diameter of the roll of paper 120.

And, the created counter-electromotive force becomes larger as the rotational speed becomes faster. Therefore, the created counter-electromotive force becomes larger as the conveyance speed of the roll of paper 120 becomes faster.

At this time, because a counter-electromotive force coefficient is the same as a torque constant in the same motor, the back tension force for the roll of paper 120 changes in accordance with the conveyance speed of the roll of paper 120.

However, in the case where the size of the paper is different, because the back tension force per unit of conveyance force must be considered, the outside diameter and the size of the roll of paper 120 should be taken into account when calculating the conveyance speed of the roll of paper 120.

Figure 9:
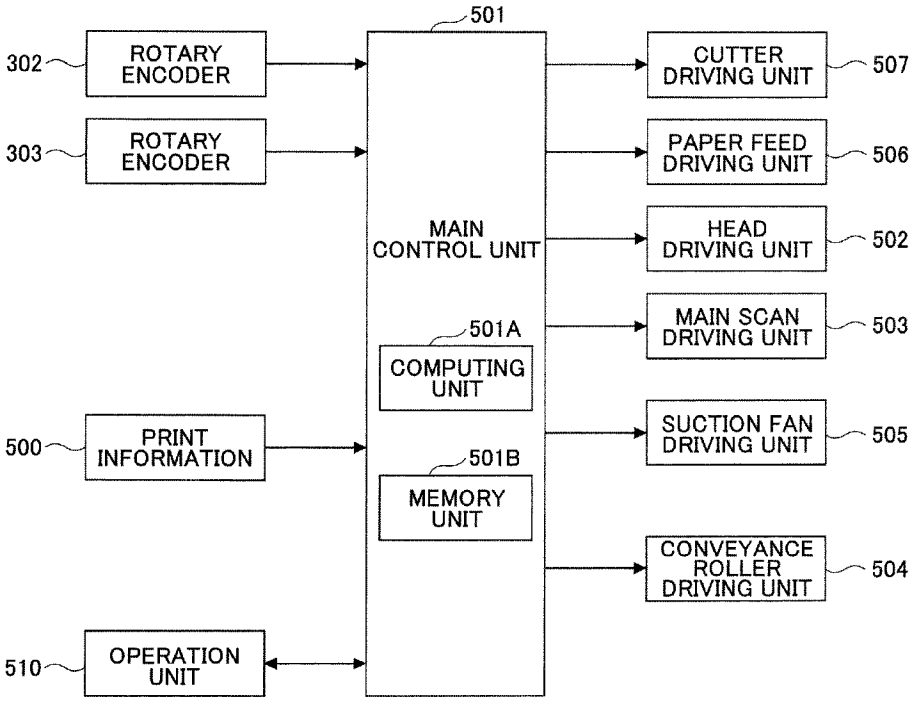
FIG. 9 is a block diagram illustrating an outline of a control unit of the image forming apparatus.

Next, an outline of a control unit of the image forming apparatus will be described referring to the block diagram of FIG. 9.

A main control unit 501 includes a CPU, a ROM, a RAM, and a microcomputer for I/O; a computing unit 501A which includes the CPU; a memory unit 501B which includes the ROM, the RAM, etc.; and assumes roles including a role of controlling the power supply for the drive motor 200 which is a driving source of the load applying unit 301.

To this main control unit 501, print information 500 provided by a host side is input. And, in order to form an image in accordance with the print information 500, the conveyance roller pair 131 is driven via a paper feed driving unit 506 so that the roll of paper 120 is fed and conveyed from the roll body 112 of the upper-level or the lower-level of the paper feeding apparatus 102.

Note that, in this image forming apparatus, a rotational force of the drive motor 200 of the load applying unit 301 described above is transmitted to the conveyance roller pair 131 via a clutch mechanism. In other words, the state of the drive motor 200—a forward-rotation state, a backward-rotation state, a no-power state, or a less-than-minimum-driving-voltage-applied state—is switched by the paper feed driving unit 506. Also, in the case where the drive motor 200 is put in an electrically shorted state, for example, a switching unit is provided in the paper feed driving unit 506 for opening and closing a switch between power supply terminals of the drive motor 200 so that the ON/OFF control of the switch is performed by the main control unit 501.

In other words, a unit is provided in which the drive motor 200 as a driving source is caused to be in an electrically shorted state or in a state where a voltage less than the minimum driving voltage is applied to the drive motor 200, so that a counter-electromotive force is created when the drive motor 200 receives a rotational force from the side of the roll body 112.

Also, the main control unit 501 forms a predefined image on the roll of paper 120 by: controlling the driving of the main scanning motor 6 via a main scan driving unit 503 to cause the carriage 5 to move for scanning in the main scanning directions; driving the conveyance roller 23 via a conveyance roller driving unit 504 to rotate; driving the suction fan 26 via a suction fan driving unit 505; moving (conveying) the roll of paper 120 in the sub scanning direction; controlling the driving of the recording head 11 via a head driving unit 502 in accordance with the print information 500; and causing the recording head 11 to jet predefined droplets.

Also, the main control unit 501 drives the cutter 27 via a cutter driving unit 507 and causes the cutter 27 to cut the printed part of the roll of paper 120 in a predefined length after the image is formed.

To this main control unit 501, various kinds of detected signals, such as detected signals from the rotary encoders 302 and 303, are input.

Also, an operation unit 510 is connected to the main control unit 501. From this operation unit 510, a type of the roll of paper 120, etc., can be input. The type or the size of the roll of paper 120 that should be used can be input from the host side connected to the image forming apparatus, and can be used as print medium information.

Note that regarding the size of the roll of paper 120, it may be detected by a paper-end detecting sensor included in the carriage 5 or by a paper-size detecting sensor included in a roll body setting location.

Figure 10:
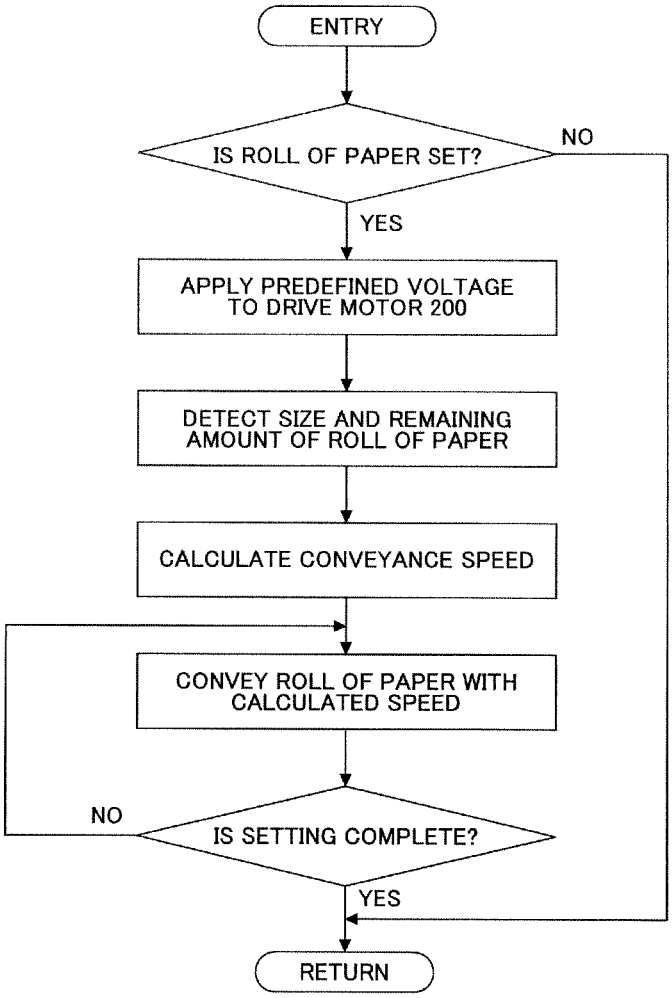
FIG. 10 is a flowchart illustrating conveyance control of the roll of paper by the control unit at the time of setting the roll of paper.

Next, conveyance control of the roll of paper by the control unit 501 at the time of setting the roll of paper 120 will be described referring to the flowchart of FIG. 10.

First, it is determined whether the roll of paper 120 is set. If the roll of paper 120 is set, then a voltage less than the minimum driving voltage (predefined voltage) is applied to the drive motor 200. By this, as described above, the load applying unit 301 is caused to be in a state of applying a back tension in accordance with the conveyance speed.

Then, the remaining amount and the size of the roll of paper 120 of the roll body 112 is detected, the conveyance speed of the roll of paper 120 is calculated, the driving of rotation of the conveyance roller 23 is controlled, and the roll of paper 120 is conveyed at the calculated conveyance speed. At this time, the conveyance roller pair 131 is opened and only the conveyance roller 23 and the pressurizing roller 24 are used for the conveyance. By this, an appropriate back tension is applied to the roll of paper 120 and the skewed conveyance of the roll of paper 120 at the conveyance roller 23 can be quickly corrected.

Then, the process is completed by setting the roll of paper 120, for which the correction of the skewed conveyance is completed, in a state where an image forming can be started.

Figure 11:
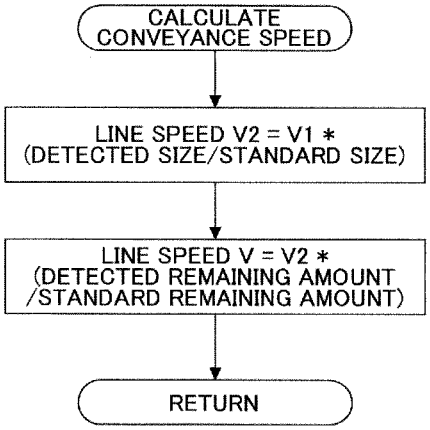
FIG. 11 is a flowchart illustrating an example of a conveyance speed calculating process.

Next, a conveyance speed calculating process will be described referring to the flowchart of FIG. 11.

Here, a conveyance speed corresponding to a predefined size (referred to as "standard size") and a predefined remaining amount (referred to as "standard remaining amount") is stored as a standard conveyance speed (referred to as "standard line speed V1").

At the time of conveyance speed calculation, a conveyance speed (line speed) V2 is calculated from the size of the installed roll of paper 120 (detected size) and the standard size by calculating the formula: standard line speed V1*(detected size/standard size).

Then, the conveyance speed (line speed) V is calculated from the remaining amount of the installed roll of paper 120 (detected remaining amount) and the standard remaining amount by calculating the formula: line speed V2*(detected remaining amount/standard remaining amount).

The roll of paper 120 is conveyed at the conveyance speed V calculated above.

In the case where the detected size of the roll of paper 120 is greater than the standard size, for example, the conveyance force becomes greater compared to the back tension. So, by causing the conveyance speed to be faster than the standard speed, the counter-electromotive force becomes greater as shown in FIG. 8 as described above and the back tension force applied for the unit conveyance force is caused to be greater. In the case where the detected size is smaller than the standard size, on the other hand, the back tension force becomes greater so that the back tension force per unit conveyance force is caused to be smaller by causing the conveyance speed to be slower than the standard speed.

Likewise, in the case where the detected remaining amount of the roll body is smaller than the standard remaining amount, the back tension force becomes smaller because of the decrease of moment of inertia in accordance with the increase of the outside diameter of the roll of paper 120 so that the back tension force per unit conveyance force is caused to be greater by causing the conveyance speed to be faster than the standard speed. In the case where the detected remaining amount is smaller than the standard remaining amount, on the other hand, the back tension force becomes greater so that the back tension force per unit conveyance force is caused to be smaller by causing the conveyance speed to be slower than the standard speed.

As described above, the back tension can be changed by changing the conveyance speed in accordance with the size and the remaining amount of the roll of paper 120, and an appropriate back tension can be applied. Note that regarding the changing of the conveyance speed, the conveyance speed can be changed continuously or changed in stages. Also, the conveyance speed may be configured to be only changed to become greater than the standard speed, or to be only changed to become smaller than the standard speed.

Note that, in the above embodiment, the size and the remaining amount of the roll of paper 120 is used, but the diameter of the roll of paper 120 can be detected and used for changing the conveyance speed. In this case, in the case where the diameter of the roll of paper 120 is greater than the standard diameter, the same control is performed as the case above where the remaining amount is greater than the standard amount, and in the case where the diameter is smaller than the standard diameter, the same control is performed as the case above where the remaining amount is smaller than the standard amount.

As described above, the force of back tension can be changed with a simple configuration or a simple control: by including a unit for, in order to create counter-electromotive force when a driving source receives rotational force from a roll body, causing the driving source to be in an electrically shorted state or applying a voltage less than a minimum driving voltage to the driving source; by including a conveyance speed changing unit for changing a conveyance speed of conveying a print medium by a conveyance unit; by causing the driving source to be in a state where it can create counter-electromotive force; and by changing the conveyance speed of the print medium so that a load, which is applied to the roll body in an opposite direction to the medium conveyance direction, is changed.

Also, as described above, by changing the conveyance speed for controlling the back tension to be a best tension, a skewed conveyance as shown in FIG. 7 can be promptly corrected before the print medium is pulled out from the roll body to be set in a position for starting the image forming.

In the above embodiment, the conveyance roller 23 and the pressurizing roller 24 are used as the conveyance unit and the correction of the skewed conveyance is performed for the paper which is already set. But the present invention is not limited to this embodiment. For example, the changing of the conveyance speed can be applied when the print medium is being pulled out from the roll body. In this case, it is preferable that, as the conveyance unit, the conveyance roller pair 131 be used instead of the conveyance roller 23 and the pressurizing roller 24.

In the present description, the material of "paper" is not limited to paper, but includes OHP, cloth, glass, substrate, etc., to which ink droplets, other liquid, etc., can be adhered. The "paper" includes what is called a recording medium, a recording paper, and a recording sheet. Also, image forming, recording, printing, etc., are used as synonyms.

Also, "image forming apparatus" means an apparatus which forms an image by jetting liquid onto a medium such as paper, thread, fiber, leather, metal, plastic, glass, wood, or ceramics. Also, "image forming" includes not only attaching a meaningful image of letters or figures to the medium but also attaching a meaningless image such as some pattern to the medium (simply attaching liquid droplets to the medium).

Also, "ink" is, unless otherwise defined, not limited to what is called ink, but is used as a general name for all liquid that can perform the image forming, such as what is called recording liquid, fixing liquid, or liquid, and, for example, DNA samples, resist, pattern member, or resin are included.

Also, an "image" is not limited to two dimensions, but it includes an image that is put on what is formed in three dimensions, and an image that is formed in three dimensions.

Also, the image forming apparatus, unless otherwise defined, includes a serial type image forming apparatus and a line type image forming apparatus.

Also, in the above embodiment, the image forming unit is described as a liquid-jet head, but it is not limited to this embodiment and a contact-type or a non-contact type image forming unit can be used as the image forming unit. The present embodiment can be also applied to an electrophotographic image forming apparatus.

Further, the present invention is not limited to these embodiments, and various variations and modifications may be made without departing from the scope of the present invention.

The present application is based on and claims the benefit of priority of Japanese Priority Application No. 2012-257984 filed on Nov. 26, 2012, with the Japanese Patent Office, the entire contents of which are hereby incorporated by reference.

What is claimed is:

1. An image forming apparatus comprising:

a roll body in which a print medium is rolled in a roll, a conveyance unit configured to convey the print medium, a load applying unit configured to apply a load to the roll body in a direction opposite to a medium conveyance direction, the load applying unit including a motor and a rotation transmission mechanism placed between the motor and the roll body, a unit configured to cause the motor to be in a state where the motor creates counter-electromotive force when rotational force from the roll body is received, by causing the motor to be in an electrically shorted state or by applying a voltage less than a minimum driving voltage to the motor, a detecting unit configured to detect print medium information of the roll body, and a conveyance speed changing unit configured to change a conveyance speed with which the conveyance unit conveys the print medium, wherein, while a portion of the print medium that is pulled out from the roll body is set in a state where image forming thereon can be started, the motor is caused to be in the state where the motor creates the counter-electromotive force, and the conveyance unit conveys the print medium while controlling the conveyance speed of the print medium in accordance with the print medium information detected by the detecting unit, and wherein the rotation transmission mechanism of the load applying unit includes a torque limiter, and a setting value of the torque limiter is greater than a drive-load torque of the motor when a voltage less than the minimum driving voltage is applied to the motor.

2. The image forming apparatus as claimed in claim 1, wherein the print medium information includes a diameter of the roll body, a remaining amount of the rolled print medium, or a size of the roll body.

3. The image forming apparatus as claimed in claim 1, further comprising:

a unit configured to detect a diameter of the roll body, wherein the conveyance speed changing unit changes the conveyance speed to slower when the detected diameter of the roll body is relatively smaller and changes the conveyance speed to faster when the detected diameter of the roll body is relatively larger.

4. The image forming apparatus as claimed in claim 1, further comprising:

a unit configured to detect a remaining amount of the rolled print medium, wherein the conveyance speed changing unit changes the conveyance speed to slower when the detected remaining amount of the print medium is relatively smaller and changes the conveyance speed to faster when the detected remaining amount of the print medium is relatively larger.

5. The image forming apparatus as claimed in claim 1, further comprising:

a unit configured to detect a size of the rolled print medium, wherein the conveyance speed changing unit changes the conveyance speed to slower when the detected size of the print medium is relatively smaller and changes the conveyance speed to faster when the detected size of the print medium is relatively larger.

* * * * *